US006152395A

United States Patent [19]

Corriveau et al.

[11] Patent Number: 6,152,395

[45] Date of Patent: Nov. 28, 2000

[54] SPOOL ASSEMBLY FOR PINTLE

[75] Inventors: André Corriveau; James Corriveau, both of Rock Forest; Jacques Laval, Melbourne, all of Canada

[73] Assignee: Lippert Pintlepin Mfg. Inc., Rock Forest, Canada

[21] Appl. No.: 09/320,587

[22] Filed: May 27, 1999

[30] Foreign Application Priority Data

May 29, 1998 [CA] Canada ..... 2236726
Jan. 14, 1999 [CA] Canada ..... 2257553

[51] Int. Cl.[7] ..... B65H 75/40

[52] U.S. Cl. ..... 242/388.6; 242/396.4; 242/405.3

[58] Field of Search ..... 242/396.4, 388.6, 242/388.7, 405, 405.3, 132, 137, 137.1, 138, 146

[56] References Cited

U.S. PATENT DOCUMENTS

| | | | |
|---|---|---|---|
| 1,811,945 | 6/1931 | Lange . | |
| 2,314,504 | 3/1943 | Lifchultz | 242/405.3 |
| 3,424,435 | 1/1969 | Niemann . | |
| 3,686,767 | 8/1972 | Duda et al. . | |
| 3,970,264 | 7/1976 | Fredriksson et al. | 242/405.3 |
| 4,842,212 | 6/1989 | Loiselle et al. . | |
| 5,033,618 | 7/1991 | Edens . | |
| 5,074,074 | 12/1991 | Yeadon | 242/405 |
| 5,245,761 | 9/1993 | Waldherr . | |
| 5,280,861 | 1/1994 | Corriveau . | |
| 5,553,820 | 9/1996 | Bobeczko . | |
| 5,630,456 | 5/1997 | Hugo et al. | 242/396.4 |
| 5,938,140 | 8/1999 | Fundak | 242/405.3 |

FOREIGN PATENT DOCUMENTS 464725 1/1992 European Pat. Off. .

*Primary Examiner*—John M. Jillions
*Attorney, Agent, or Firm*—Robic

[57] ABSTRACT

The spool assembly for storing and handling a wire or cable, especially a pintle, has a spool that is annular in shape and devised to define a radially outwardly opened rim of U-shaped cross-section in which the wire can be wound. At least one of the side walls of this rim has an outer edge with teeth formed in it. The spool is freely mounted and retained in a spool-receiving member having a surrounding wall with an outlet through which the wire may exit. A brake is provided to prevent the spool from rotating when such is not required. The brake comprises a tiltable arm extending tangentially close to the spool. One or more teeth project from the arm towards the periphery of the spool so as to engage the teeth of the spool and thus prevent the spool from being rotated unless the arm is lifted up. One or more stoppers may also be provided to lock the wire. The assembly is preferably made of plastic material. It is very simple in structure and very handy to use.

17 Claims, 13 Drawing Sheets

SPOOL ASSEMBLY FOR PINTLE

BACKGROUND OF THE INVENTION a) Field of the Invention

The present invention relates to a spool assembly for use in storing and handling a wire or a cable, which is preferably but not necessarily a pintle.

b) Brief Description of the Prior Art

In the paper making industry, it is of common practice to use fabric belts that are made of sections connected to each other to form an endless loop. Such belts carry the wet fibrous sheets that are prepared from the processed pulp. It is also of common practice to connect the adjacent ends of the belt sections by means of seams made by passing a cable known in the trade as a «pintle» through a tubular passage formed by intermeshed loops of fabric yarns projecting at the ends of the adjacent sections when the same are interfitted and held together. Usually, the pintle consists of a mono-or multi-filament yarn whose leading end is attached to a stiff guiding wire made of metal, which acts as a needle to facilitate insertion of the yarn into the passage formed by the loops.

Further information regarding the use of pintles to connect fabric belt sections, can be found to the preambles of U.S. Pat. No. 4,842,212 to ASTEN GROUP, INC. and U.S. Pat. No. 5,033,618 to ALBANY INTERNATIONAL CORP.

Of course, it is necessary that the pintle be stored and made available in such a manner as to make its use and installation as fast and easy as possible, especially in the case of replacement of used or damaged sections of the belt of a paper making machine, which must be made in a very fast manner on the premises.

Spool assemblies for pintles have already been devised to meet the above mentioned requirement. In this connection, reference can be made again to the above mentioned patents, which are both directed to such assemblies. Reference can also be made to U.S. Pat. No. 5,280,861 in the name of LIPPERT PINTLEPIN MFG. INC. which discloses a spool assembly comprising one or two cylindrical spools in which pintles can be wound. One or two cylindrical spool-receiving members are provided. Each of them has a cylindrical peripheral wall, a flange preferably in the form of a ring projecting radially inwardly from one of the edges of the peripheral wall to hold one of the spools, a plurality of hooks integral to and projecting from the other edge of the peripheral wall at given intervals, and an outlet provided in the peripheral wall to allow the pintle wound in the groove of the spool to be pulled out. The spool assembly disclosed in this patent also comprises a flat, preferably ring-shaped circular cover having an external diameter that can be engaged by the hooks and held tight by these hooks against the other edge of the spool receiving member, to form therewith a casing in which each spool is freely mounted. A stopper is devised to be snapped onto the casing formed by each spool receiving member and the corresponding cover, in order to rigidly hold any portion of the pintle projecting outwardly from the casing through the opening and thus to prevent the pintle from winding back into the corresponding spool-receiving member when such is not wanted.

Even if the structural components of the spool assembly disclosed in this U.S. Pat. No. 5,280,861 are easy to assemble and use, it has now been found a simpler and more efficient way to design and assemble together the structural components of a spool assembly. It has also been found a better and more efficient way of controlling the exit of the pintle when it is pulled out.

OBJECT AND SUMMARY OF THE INVENTION

Thus, an object of the present invention is to provide a spool assembly for wires, cables, pintles and the like, which is very simple in structure and very handy to use.

More specifically, the object of the invention is to provide a spool assembly comprising only two basic components, namely a spool and a spool receiving member incorporating a brake and, optionally, a set of stoppers as parts of its structure.

The spool assembly according to the invention basically comprises:

- a spool of given outer diameter and thickness on which the wire to be stored can be wound, the spool being annular in shape and devised to define a radially outwardly opened rim of U-shaped cross-section in which the wire can be wound, the rim having a bottom wall in he form of an annular ring and two side walls in the form of flat rings that project radially outwardly form both sides of the annular ring, at least one of the side walls having an outer edge with teeth formed in it, the teeth being equally spaced-apart, identical in size and all oriented in a same direction; and
- a spool-receiving member comprising;
  - a spool-receiving element comprising a surrounding wall having an inner diameter and a width selected to match with the outer diameter and thickness of the spool, and a ring-shaped wall that projects radially inwardly from one side of the surrounding wall to provide a lateral support on one side of the spool;
  - means connected to the spool-receiving member for catching the spool and freely retaining this spool within the spool-receiving element;
  - a brake connected to the spool-receiving member, the brake comprising a tiltable arm extending substantially tangentially close to the spool and at least one tooth projecting from the tiltable arm towards the spool so as to contact the spool, said at least one tooth being shaped, sized and oriented in a direction opposite to the direction of the teeth made on the one side wall of the spool so as to engage these teeth and thus to prevent the spool from being rotated in the said direction unless the arm tilted is up.

Preferably, the spool assembly further comprises at least one stopper fixed to the spool-receiving member, this stopper comprising a rod extending transversely close to the surrounding wall of the spool-receiving member away from the outlet at a short distance, and a rubber cap having radially projecting flanges on part of it the cap being fitted onto the rod and sized so that, when it is rotated, its flanges may come into contact with the surrounding wall and pinch the wire extending on it, thereby locking said wire.

Preferably also, each of the structural components of the spool assembly according to the invention is made of plastic material.

In a first preferred embodiment of the invention:

- the means for catching the spool consists of a set of circumferentially spaced-apart hooks projecting from the ring-shaped wall, these hooks being sized, positioned and oriented to catch the spool and freely retain it within the spool-receiving element;
- the spool-receiving element comprises an handle integral thereto and projecting externally therefrom;
- the tiltable arm of the brake consists of a flexible partially cut-out portion of the surrounding wall of the spool-receiving element, this cut-out portion extending below the handle; and the brake also comprises a ring integral to the flexible portion of the surrounding wall, this ring being sized, shaped and oriented in such a manner as to be engageable by one finger of a user holding the spool assembly by the handle so as to disengage the at least one tooth of the brake from the teeth of the spool.

In a second preferred embodiment of the invention:

the means for catching the spool comprises a set of circumferentially spaced-apart hooks projecting from the surrounding wall, the hooks being sized, positioned and oriented to engage a corresponding set of hook-receiving slots provided in a cover in the form of a flat ring extending in a plane perpendicular to the central axes of the spool-receiving element when hooked thereto, the cover having an external diameter long enough to make the slots engageable by the hooks and being held tight by these hooks against the spool-receiving element to form therewith casing in which the spool is freely mounted; and the tiltable arm of the brake is held onto the spool-receiving member between a bead projecting from the surrounding wall and a claw projecting from the cover so as to extend just above the bead when the spool-receiving element is properly connected to the cover, the bead and claw acting together as a pivot for the tiltable arm when the same is slid and snapped therebetween.

As can be appreciated, the spool assembly according to the invention is very simple in structure and assembly in addition of being versatile in use.

The invention and its advantages will be better understood upon reading the following non-restrictive description of a preferred embodiment thereof, made with reference to the accompanying drawings.

DESCRIPTION OF TWO PREFERRED EMBODIMENT OF THE INVENTION

Figure 5:
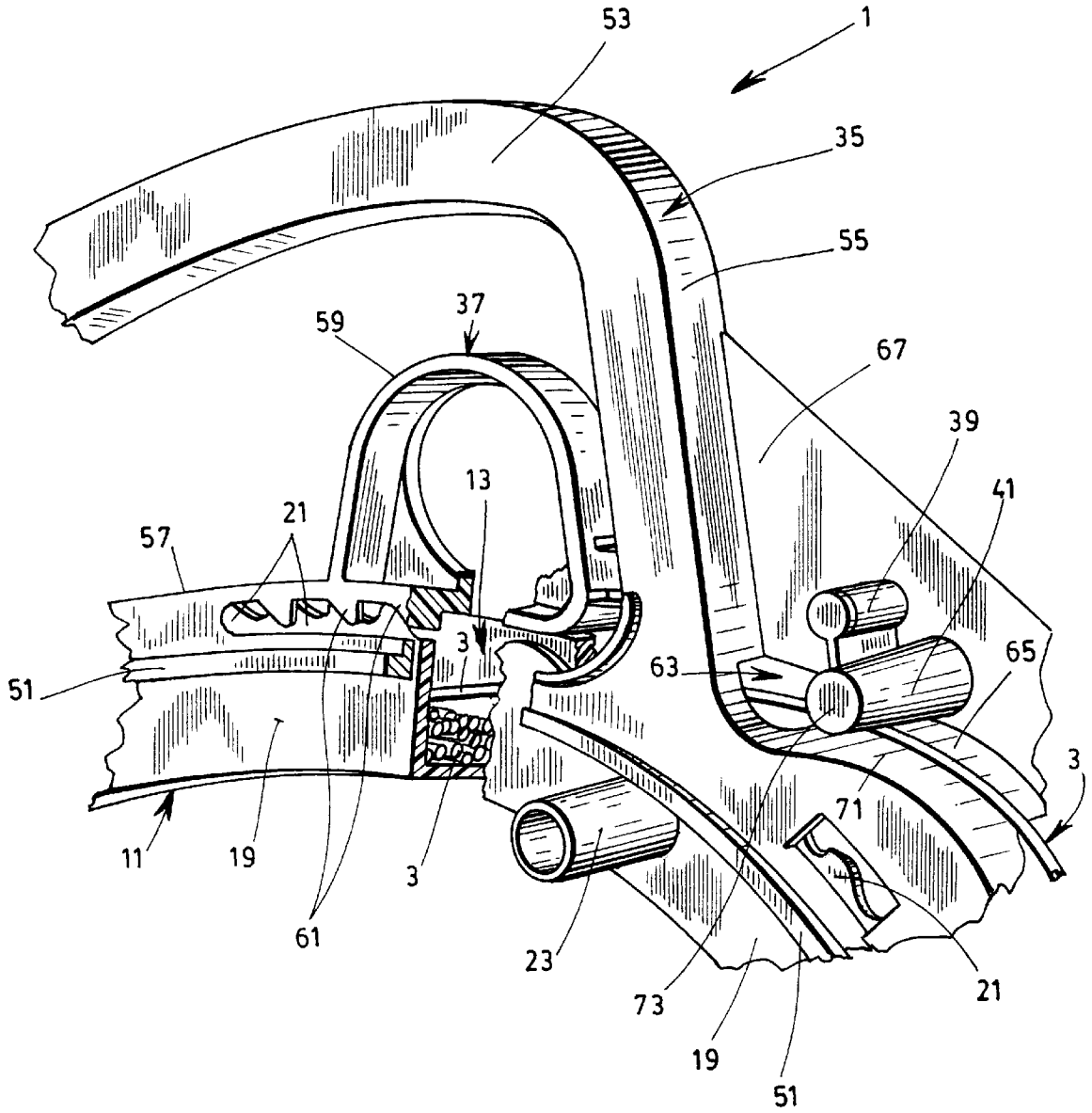
FIG. 5 is an enlarged front perspective view in partial cross-section of the upper portion of the spool assembly shown in FIG. 1, with the spool and the spool-receiving member illustrated in assembled position.
Figure 6:
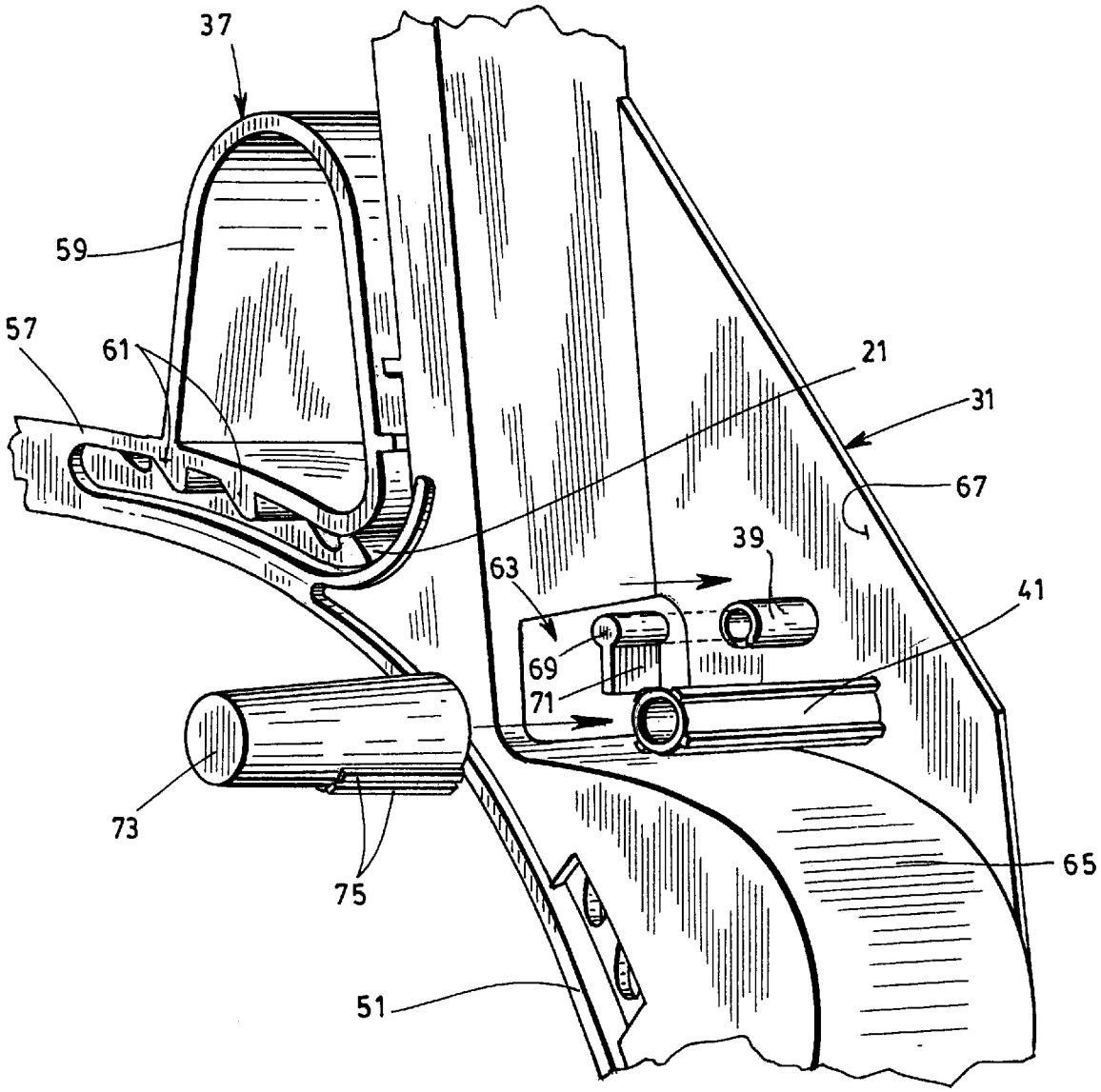
FIG. 6 is a view similar to the one shown in FIG. 5 but taken from a different angle, said Figure showing details of the stoppers that are parts of the spool-receiving member.
Figure 7:
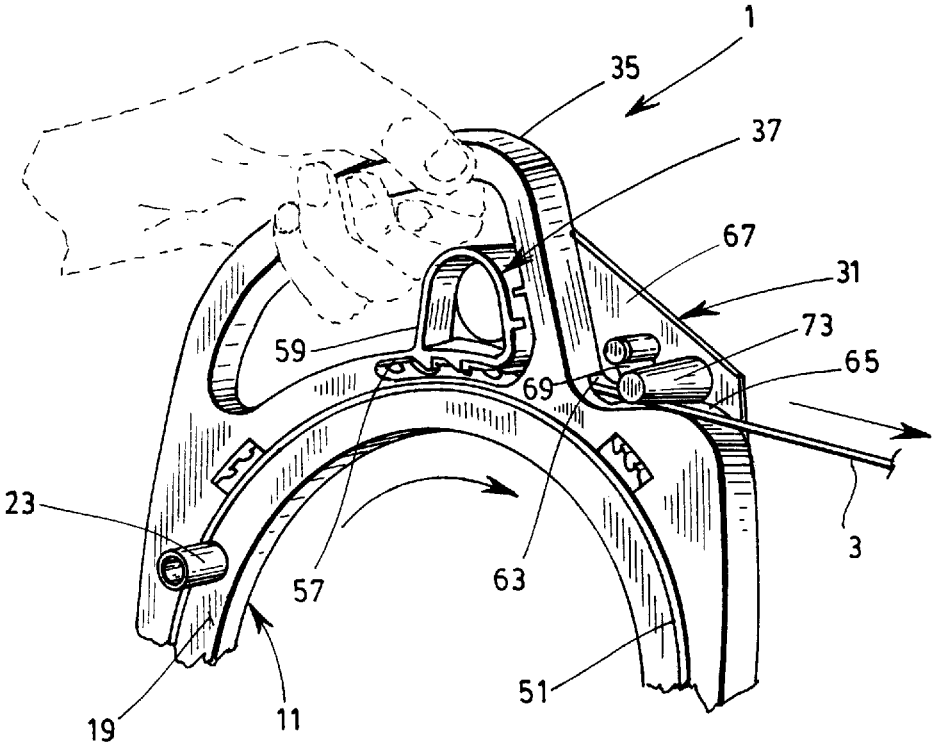
FIGS. 7 and 8 are front perspective views of the upper portion of the spool assembly according to the first preferred embodiment of the invention as shown in FIGS. 1 to 6, when used to unwind the pintle (FIG. 7) and to rewind the same (FIG. 8)
Figure 8:
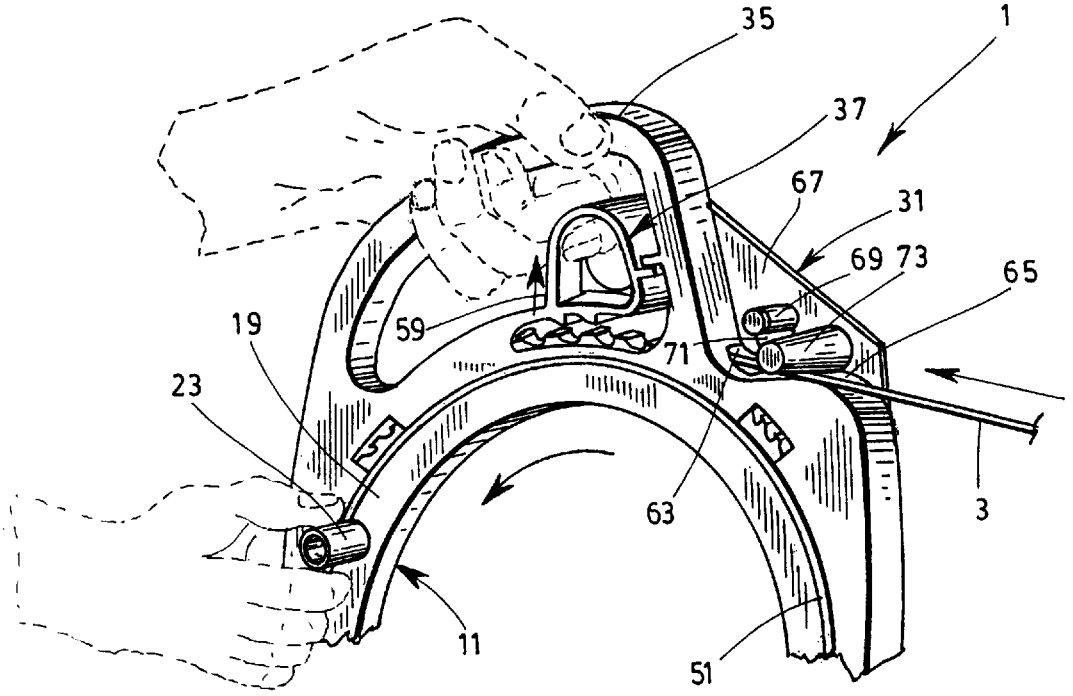

The spool assembly 1 according to the first preferred embodiment of the invention as shown in FIGS. 1 to 8 of the accompanying drawings, is intended to be used for storing and handling a wire or cable, such as a pintle 3 (see FIGS. 5, 7 and 8).

Figure 1:
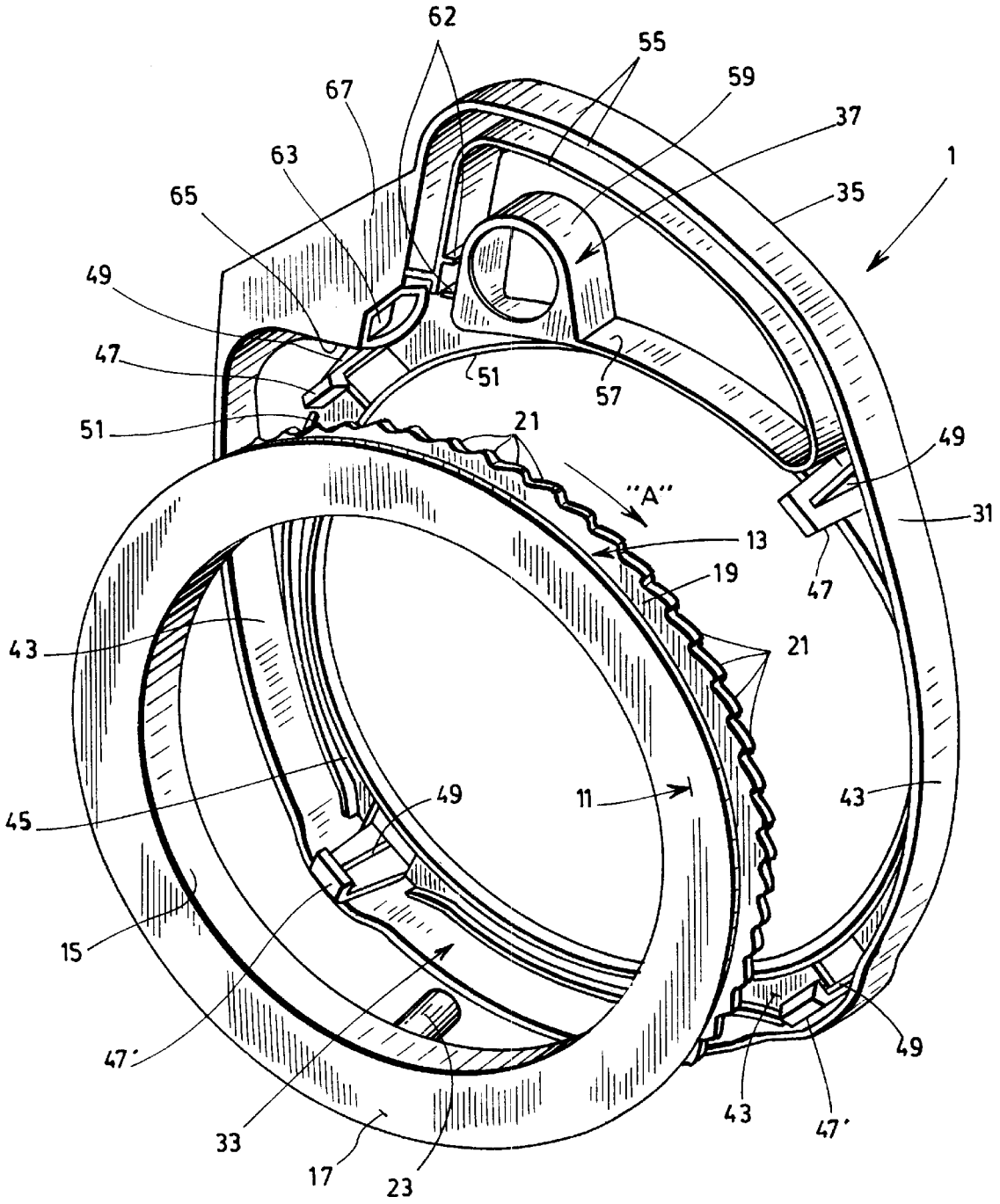
FIG. 1 is an exploded rear perspective view of a spool assembly according to a first preferred embodiment of the invention, showing its two basic structural components, viz. the spool and the spool-receiving member.

As shown in FIG. 1, the spool assembly 1 comprises two basic components, each of which is preferably made of plastic material. These components are:

a spool 11 on which the pintle 3 to be stored can be wound; and a spool-receiving member 31 for receiving and holding the spool 11.

As is shown in FIGS. 1 and 5, the spool 11 is annular in shape and devised to define a radially outwardly opened rim 13 of U-shaped cross-section in which the pintle 3 can be wound. The rim 13 has a bottom wall in the form of an annular ring and two side walls 17, 19 in the form of flat rings that project radially outwardly from both sides of the annular ring. As can be seen, the side walls 17,19 have substantially the same outer diameter. One of the side walls, viz. the one numbered 19, has an outer edge with teeth 21 formed in it. The teeth 21 formed in this outer edge are equally spaced-apart, identical in size and all oriented in the same direction "A". The utility of these teeth 21 will be explained hereinafter. The spool 11 also comprises a stem 23 integral to and projecting externally from the side wall 19. This stem 23 provides a finger grip to the user and makes easier for this user to impart rotation to the spool whenever such is desired.

Figure 2:
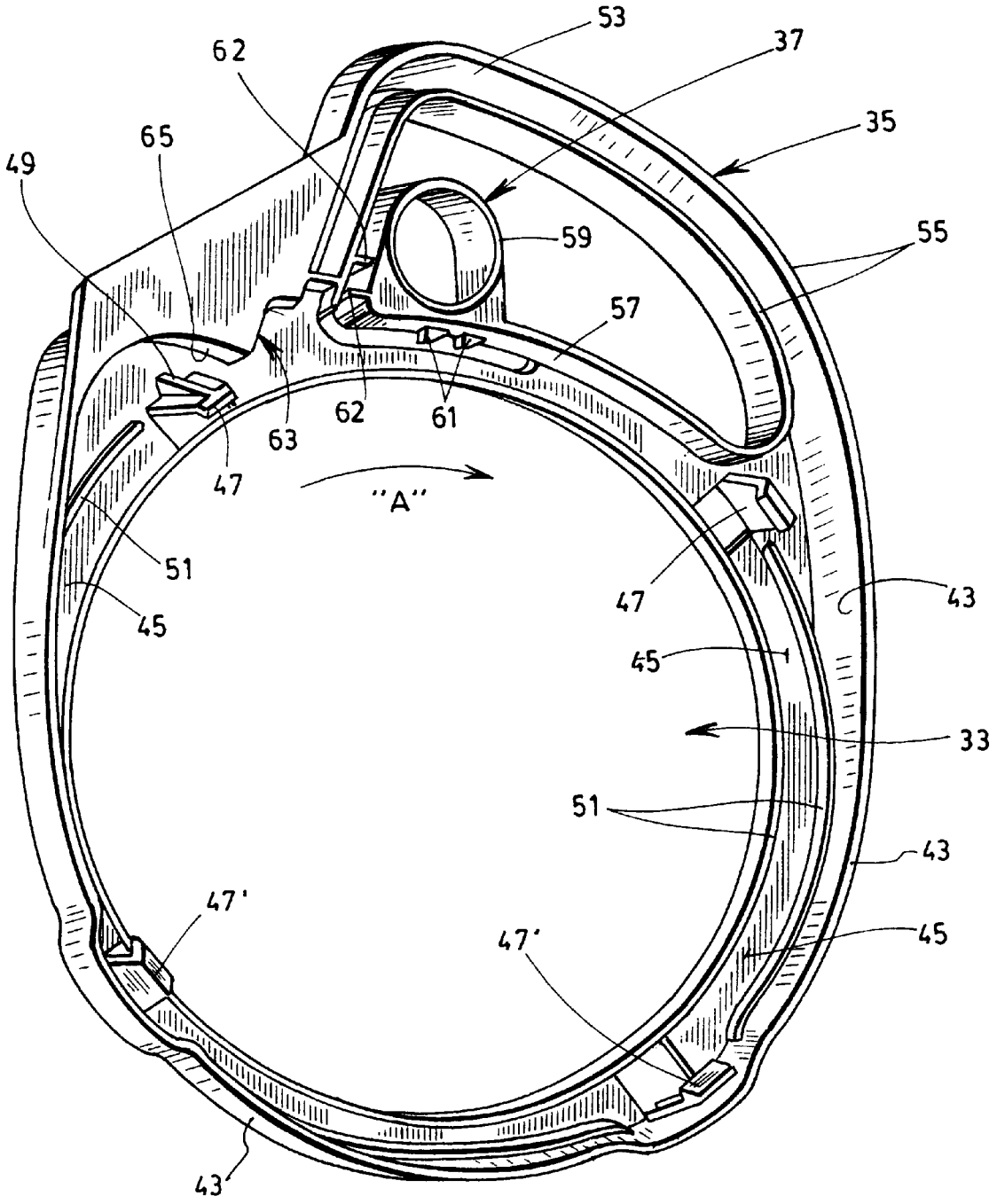
FIGS. 2 and 3 are rear and front perspective views, respectively, of the spool-receiving member of the spool assembly shown in FIG. 1.
Figure 3:
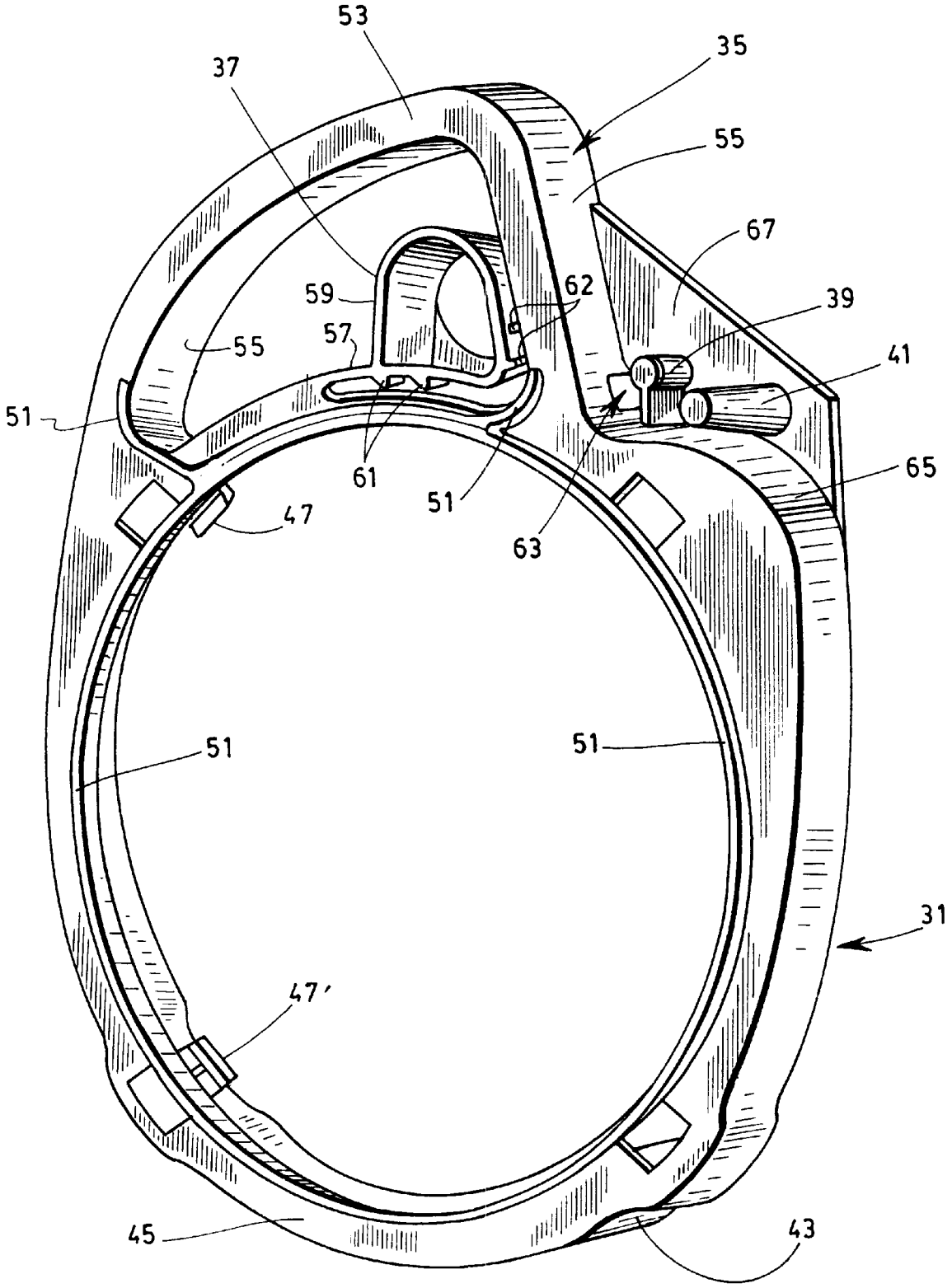
Figure 4:
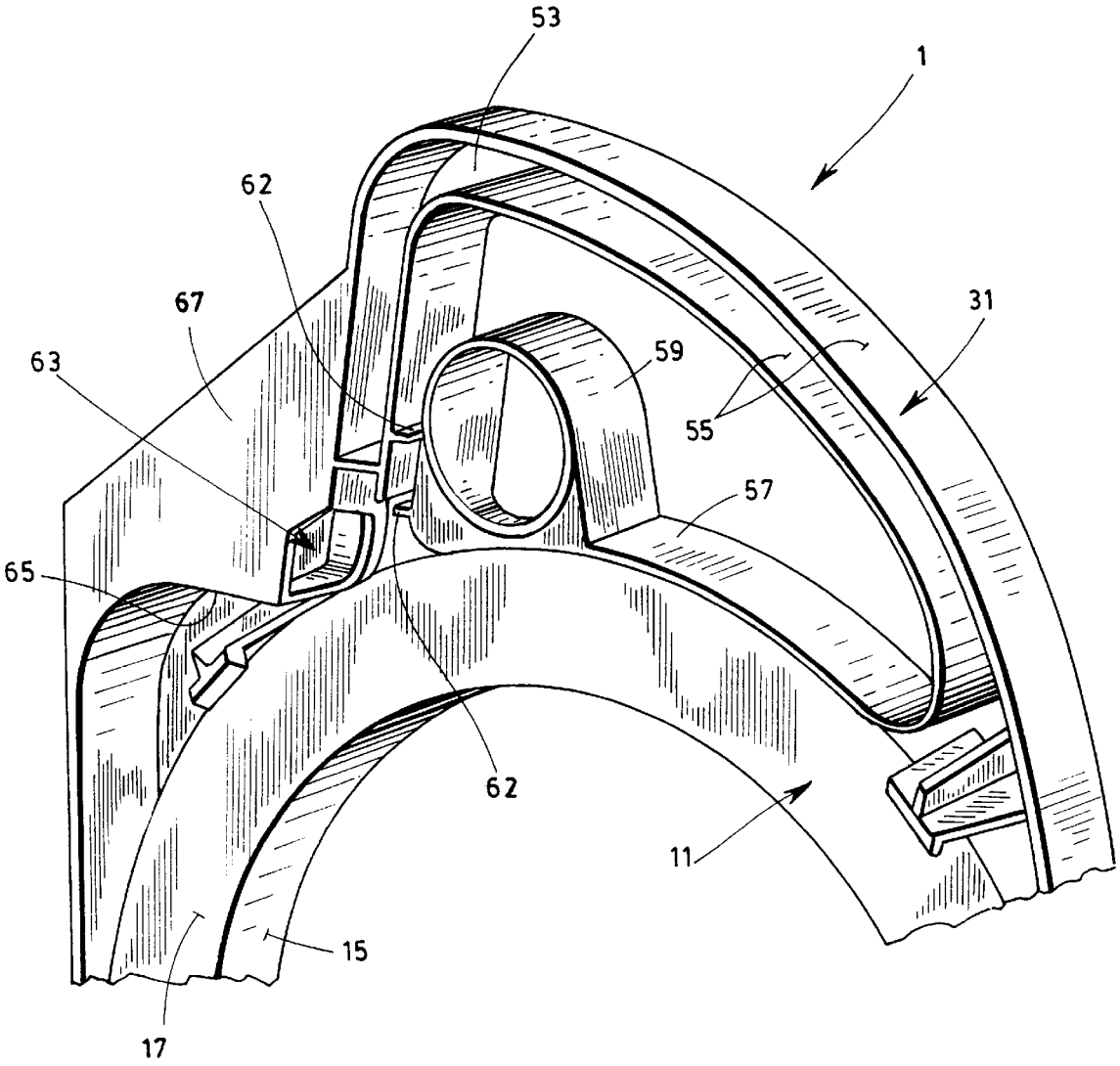
FIG. 4 is an enlarged rear perspective view of the upper portion of the spool assembly shown in FIG. 1, with the spool and the spool-receiving member illustrated in assembled position.

As is better shown in FIGS. 2 and 3, the spool-receiving member 31 of the spool assembly 1 according to the first embodiment of the invention is made of one piece only. It consists of a spool-receiving element 33 and it further incorporates a handle 35, a brake 37 and an optional set of stoppers.

The spool-receiving element 33 comprises a surrounding wall 43 whose inner diameter and width are selected to "match" with the outer diameter and thickness of the spool 11. It also comprises a ring-shaped wall 45 that projects radially inwardly from one side of the surrounding wall 43 to provide a lateral support and thus to retain the spool 11 when the same is inserted into the spool-receiving element with its toothed side wall 19 in contact with the wall 45 (see FIG. 1).

Means are provided for catching the spool 11 and retaining it into the spool receiving element 33. In this first preferred embodiment, these catching means consist of a set of circumferentially spaced-apart hooks 47, 47' that project upwardly from the wall 45. These hooks are sized, positioned and oriented to "catch" the outer edge of the other side wall 17 of the spool in order to freely retain the same within the spool-receiving element 33. The expression "to freely retain" as used hereinabove and is the accompanying claims, means to hold and retain the spool 11 within the element 45 while allowing it to be rotated coaxially therewith either by pulling the pintle 3 out of the spool or by manually imparting a rotation to the spool via the stem 23.

As is shown, each hook 47, 47' is provided with a reinforcing flange 49. In the illustrated embodiment, there are four hooks and two of them (those numbered 47') have their flanges 49 positioned in such a manner as not to infer with their flexibility, thereby making it possible to easily "snap" the spool 11 within the spool-receiving element 43 and to detach it from the same whenever wanted. The holes that are shown adjacent to each hook on the accompanying drawings, are just there for molding purpose.

As is also shown, other reinforcing flanges 51 may advantageously be provided onto the inner and outer edges of the ring-shaped wall 45 both in and out of the spool-receiving element 33.

The handle 35 is integral to the spool-receiving element 33. As is shown, it is in the form of a loop and has a U-shaped cross-section with a bottom wall 53 integral to and extending in the same plane as the ring-shaped wall 45 and a pair of opposite side walls 55 integral to and extending in line with the surrounding wall 43.

The brake 37 is also integral to the spool-receiving element 33. It is located within the loop formed by the handle to allow the user to trigger it with one finger when holding the assembly (see FIG. 8). As is shown, the brake 37 comprises a tiltable arm consisting of a flexible partially cut-out portion 57 of the surrounding wall 43 of the spool-receiving element 33. This flexible portion 57 is located "below" the handle 35 as is shown in the drawings. The brake 37 also comprises a ring 59 sized to be engaged by one of the fingers of the person holding the spool assembly 1 by the handle 35 (see FIG. 8). The brake 37 further comprises at least one and preferably two teeth 61 projecting below the ring 59 towards the periphery of the spool 11. More specifically, the teeth 61 are shaped, sized and oriented in a direction opposite to the arrow "A" so as to engage the teeth 21 of the side wall 19 of the spool 11 and thus to prevent the spool from being rotated in the direction "A" unless the handle 37 is lifted up thanks to the flexibility arm-defining, cut-out portion 57. In practice, this allows the pintle 3 to be freely unwound as is shown in FIG. 7 while preventing it from inadvertently moving back into the spool assembly 1 due to a back pressure that would rotate the spool in the direction "A". This also permits to hold the spool 1 and to prevent it from rotating when not in use. If, however, one wants to rewind part of the unwound pintle 3, he or she may lift up the brake 37 as is shown in FIG. 8 and then rotate the spool 1 by means of its stem 23 to rewind the pintle. Opposite beads 62 may advantageously be provided on the adjacent portion of the handle 35 and flexible arm portion 57 to limit the motion of the brake when it is lifted up.

Of course, an outlet 63 must be provided in the surrounding wall of the spool-receiving element 33 to allow the pintle 3 wound on the spool to exit from the spool-receiving member 31. Preferably, this outlet 63 is located in a portion of the member 31 that is adjacent to the handle 35. Preferably also, the spool-receiving member 31 comprises, as part of the structure of its surrounding wall, a substantially flat supporting surface 65 external to the spool receiving element 33, just "behind" the outlet 63. The purpose of this supporting surface 65 is to support and guide the pintle 3 exiting from the outlet 63, as is better shown in FIGS. 5, 7 and 8.

Adjacent to the supporting surface 65 is a supporting wall 67 that is preferably also an integral part of the spool-receiving member 31. As is shown, this supporting wall 67 is, for obvious design reason, preferably triangular in shape and extends in a radial plane, thereby making this wall 67 parallel to the side walls 17, 19 of the spool 11 and to the ring shaped wall 45 of the spool-receiving element 33.

The supporting wall 67 supports the two stoppers already mentioned hereinabove. As is better shown in FIG. 6, the first stopper comprises of a slotted rod 39 that is integral to and projects perpendicularly from the wall 67 at a short distance away from both the outlet 63 and supporting surface 65. This slotted rod 39 is devised to receive a rubber peg 69 having a radially projecting tongue 71 which, when the peg is inserted into the rod 39, comes into contact with and bears against the supporting surface 65 and thus pinches the portion of the pintle 3 that may extend on it.

The second stopper also comprises of a rod 41 that is integral to and projects perpendicularly from the wall 67 at a short distance away from both the first stopper 39 and the supporting surface 65. This rod 41 is devised to receive a rubber cap 73 having radially projecting flanges 75 on part of its side. Once again, when the cap is fitted onto the rod 41 and properly rotated, its flanges come into contact with the supporting surface 65 and pinch the pintle 3, thereby locking it in position.

As can be appreciated, the use of one or two stoppers is just optional. However, the main advantage of using such stoppers and more especially the second one with the rod 41, is that they give to the user of the spool assembly 1 the possibility to lock the end of the pintle 3 and prevent it from moving in any direction.

The spool assembly 1 that has just been described is very simple yet efficient in structure. It comprises only two structural components (excluding the rubber peg 69 and cap 73) that are of very simple structure and easy to mold and assemble. It works as well as, not to say better than, the existing assemblies and has the same advantages. It also has the ability to prevent unwanted backward rotation of the spool.

The spool assembly 101 according to the second preferred embodiment of the invention as shown in FIGS. 9 to 15 of the accompanying drawings, is, like the one previously described, intended to be used for storing and handling a wire or a cable, especially a pintle 103. Because of the structural similarity between the spool assemblies 1 and 101, the same reference numerals have been used to identify the same structural elements, except that a distinguishing "100" has been added to all the reference numerals used to identify the elements of the spool assembly according to the second preferred embodiment of the invention.

Like the spool assembly 1, the spool assembly 101 comprises two basic components, each of which is preferably made of plastic material. These components are:

- a spool 111 on which the pintle 103 to be stored can be wound; and
- a spool-receiving member 131 for receiving and holding the spool 111.

Figure 9:
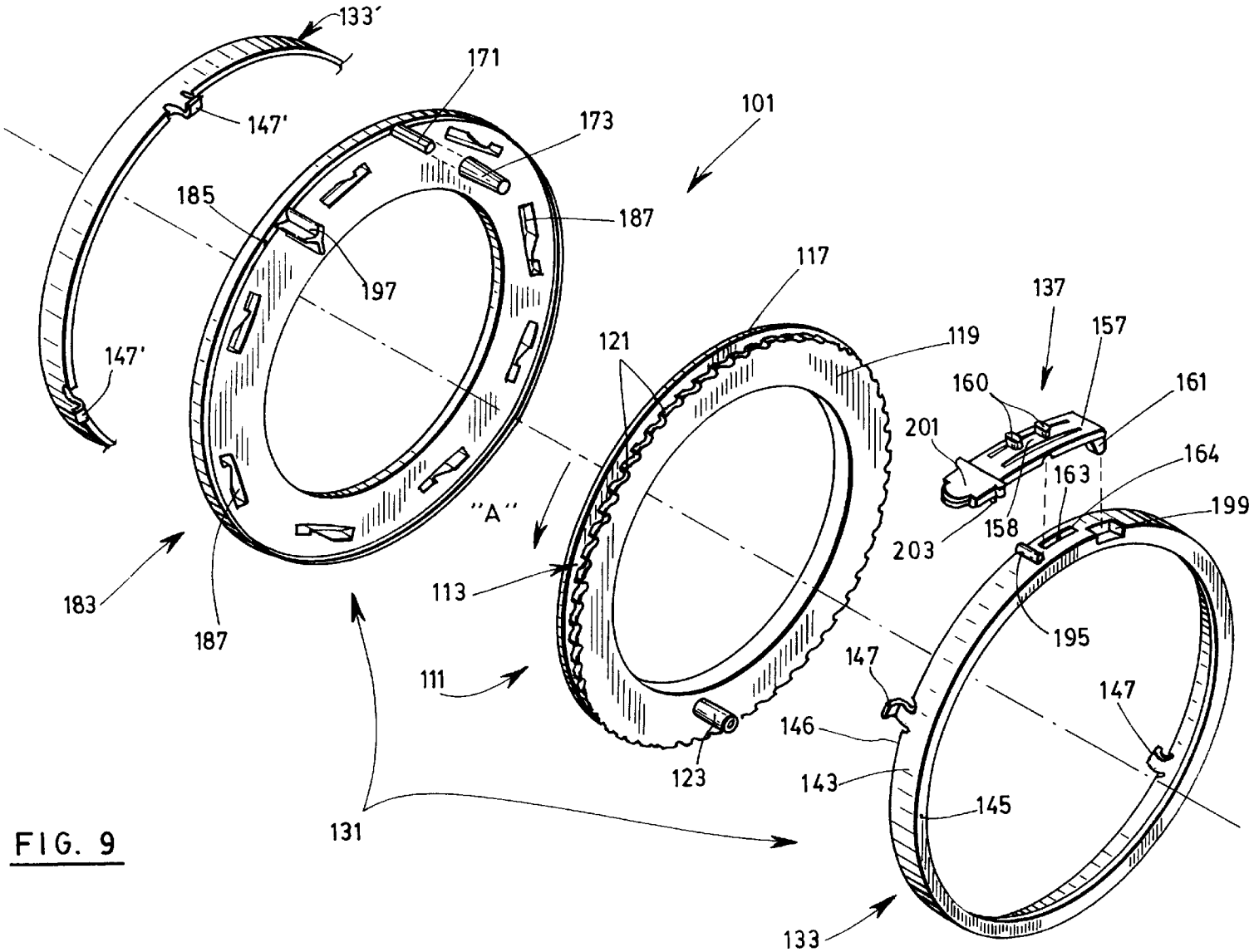
FIG. 9 is an exploded front perspective view of a spool assembly according to a second preferred embodiment of the invention.
Figure 10:
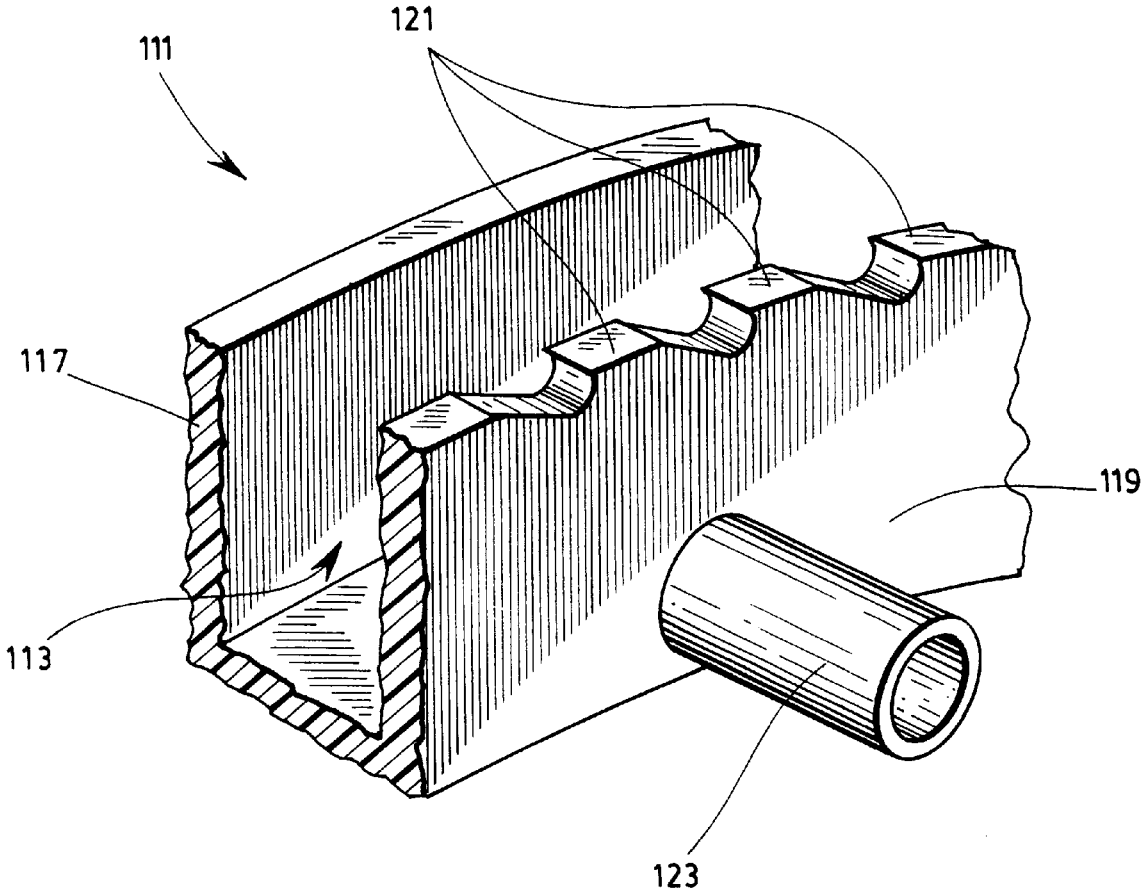
FIG. 10 is a perspective cross-section view of part of the spool of the assembly according to the second preferred embodiment of the invention as shown in FIG. 9.

As is shown in FIGS. 9 and 10, the spool 111 is structurally identical to the spool 11. It is annular in shape and devised to define a radially outwardly opened rim 113 of U-shaped cross-section in which the pintle 103 can be wound. The rim 113 has a bottom wall in the form of an annular ring and two side walls 117, 119 in the form of flat rings that project radially outwardly from both sides of the annular ring. The side walls 117, 119 have the same outer diameter and one of the side walls, viz. the one numbered 119, has an outer edge with teeth 121 formed in it. The teeth 121 are equally spaced-apart, identical in size and all oriented in the same direction "A". The spool 111 also comprises a stem 123 integral to and projecting externally from the side wall 119. This stem 123 provides a finger grip to the user and makes it easier to impart rotation to the spool whenever such is desired.

As is shown in FIGS. 9 and 11A to C, the spool-receiving member 131 of the spool assembly 101 according to the second embodiment of the invention is made of two pieces, including a spool-receiving element 133 and a cover 183.

The spool-receiving element 133 comprises a surrounding wall 143 whose inner diameter and width are selected to "match" with the outer diameter and thickness of the spool 111. It also comprises a ring-shaped wall 145 that projects radially inwardly from one side of the surrounding wall 143 to provide a lateral support and thus to retain the spool 111 when the same is inserted into the spool-receiving element with its toothed side wall 119 in contact with the wall 145 (see FIG. 9).

Means are provided for catching the spool 111 and retaining it into the spool-receiving element 133. In this second preferred embodiment, these catching means include a set of circumferentially spaced-apart hooks 147 that project away from the free edge 146 of the surrounding wall 145 in the same "plane" as this wall 145. These hooks are slightly resilient and are sized, positioned and oriented to engage a corresponding set of hook-receiving slots 187 provided in the cover 183.

The catching means also include the cover 183 which closes the spool-receiving element 133 when it is hooked to it. As is shown, the cover 183 is in the form of a flat ring which extends in a plane perpendicular to the central axis of the spool receiving element when it is hooked to it. This cover 183 has an external diameter long enough to make the slots 187 engageable by the hooks 147 and is held tight by these hooks against the free edge 146 of the spool-receiving element to form therewith a casing in which the spool 111 is freely mounted. As is also shown, the cover 183 has an external diameter that is larger than the outer diameter of the surrounding wall 143 of the spool-receiving element 133. As a result, a peripheral portion 185 of the cover projects radially outwardly from the spool-receiving element 133 when the latter is hooked to the cover 183.

Figure 11A:
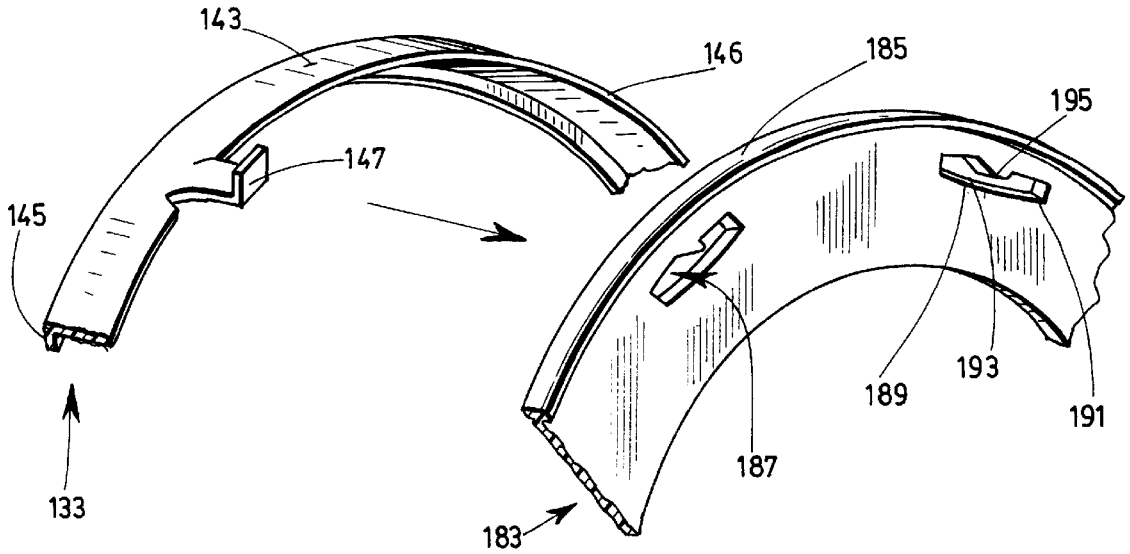
FIGS. 11A to C are perspective cross-sectional views illustrating the way of assembling the spool-receiving element and cover forming the spool-receiving member of the spool assembly according to the second preferred embodiment of the invention.

As already mentioned hereinabove, the hook-receiving slots 187 are sized and positioned as to be engageable by the hooks 147 projecting from the spool-receiving element 133. Preferably, the slots 187 comprise a first portion 189 and a second portion 191 that are spaced-apart and linked together by a channel 193 as seen in FIG. 11A. The first portion 189 is large enough to allow insertion therein of the head of one of the hooks 147. The channel 193 is wide enough to allow the central part of the hook 147 to slide within it. The second portion 191 is smaller in width than the first portion 189 and comprises a locking notch 195.

Figure 11B:
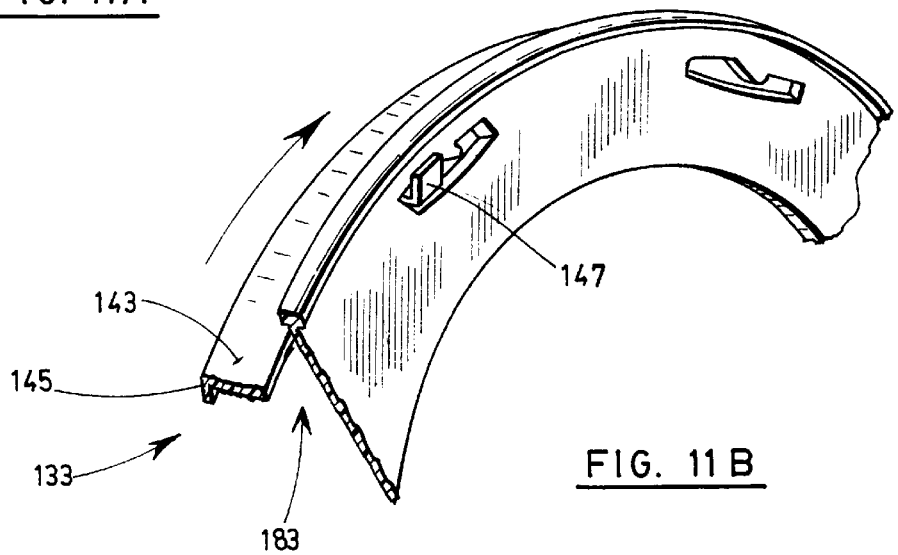
Figure 11C:
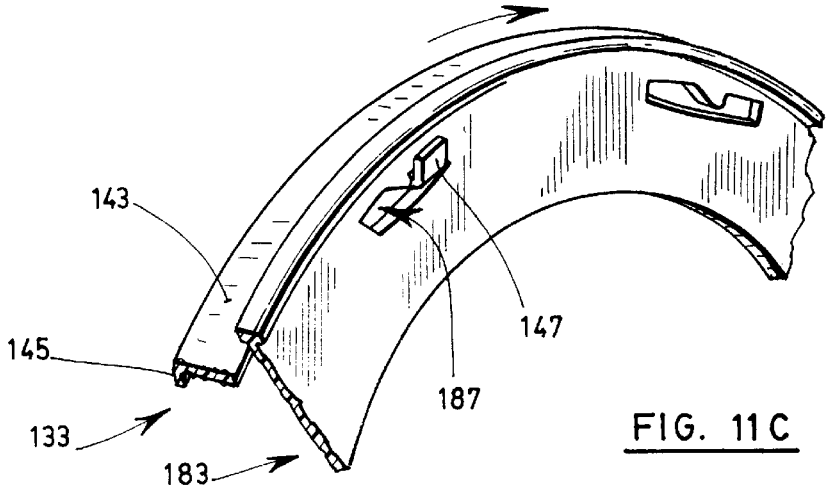
Figure 12A:
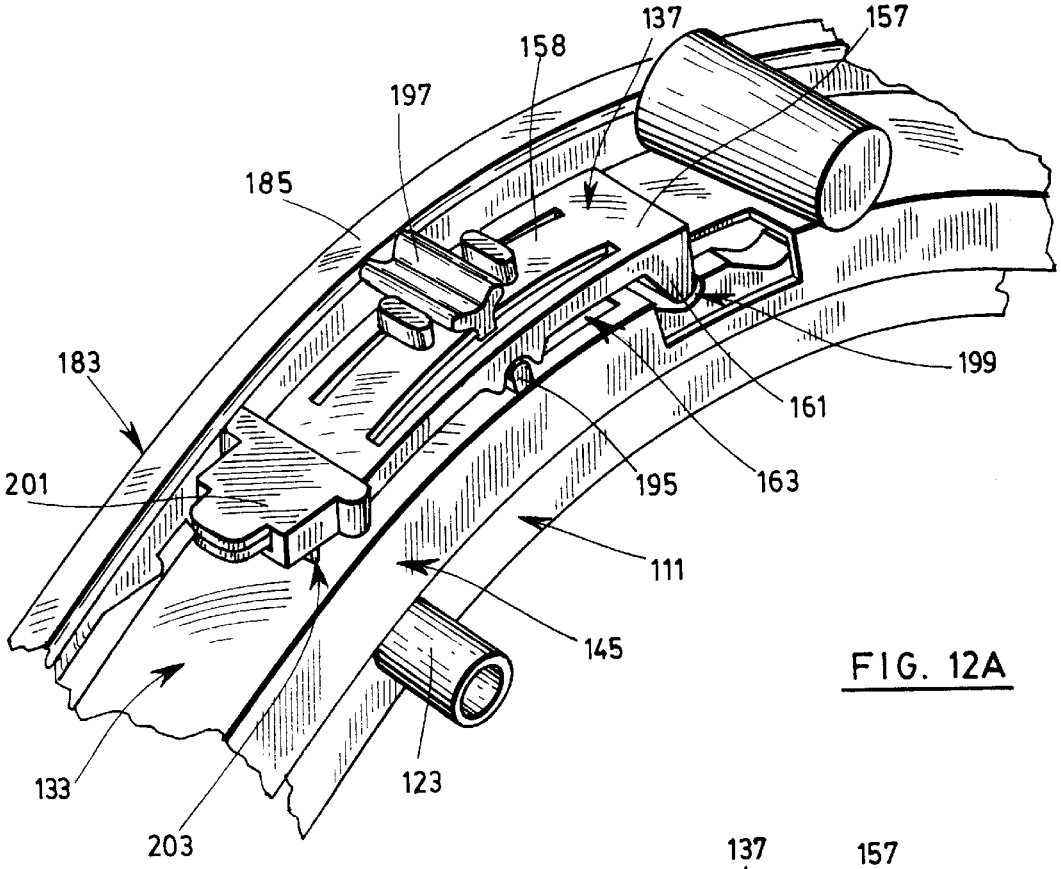
FIGS. 12A and B are perspective views showing the brake of the spool assembly according to the second preferred embodiment of the invention, FIG. 12B having part of the adjacent spool-receiving element cut away to illustrate the engagement of the tooth of the brake with the teeth of the spool.
Figure 12B:
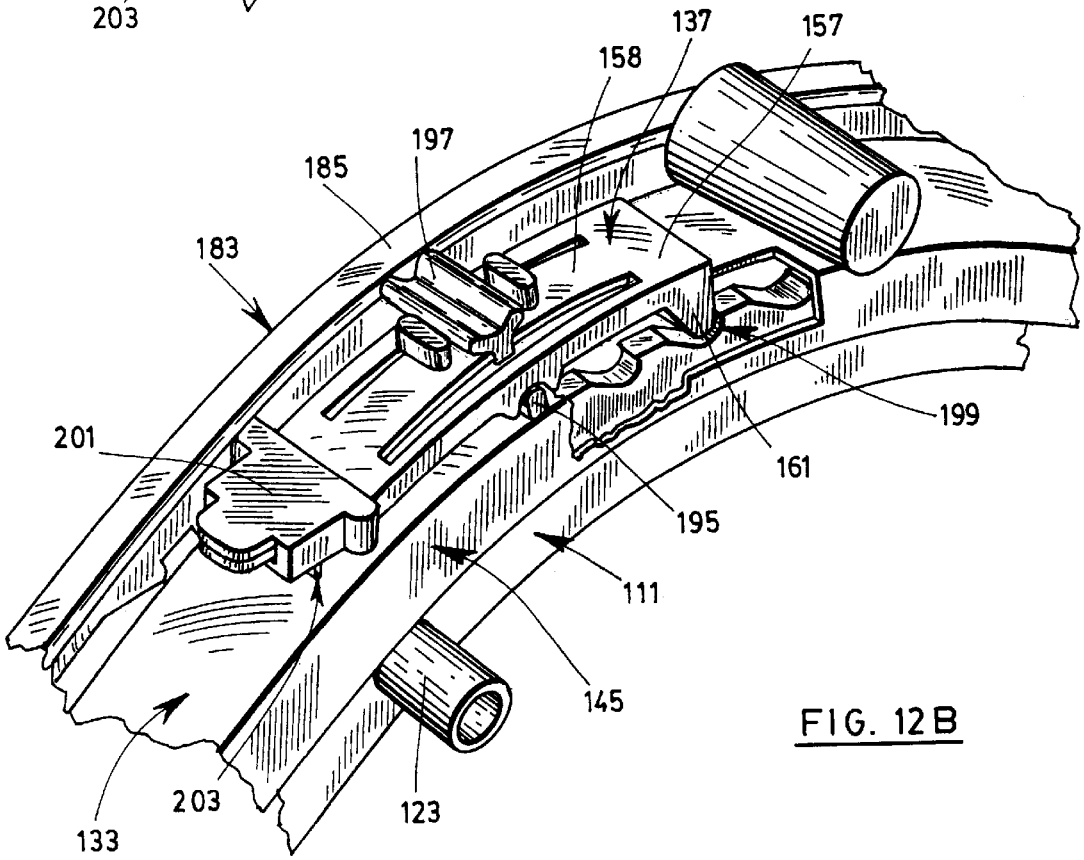
Figure 13:
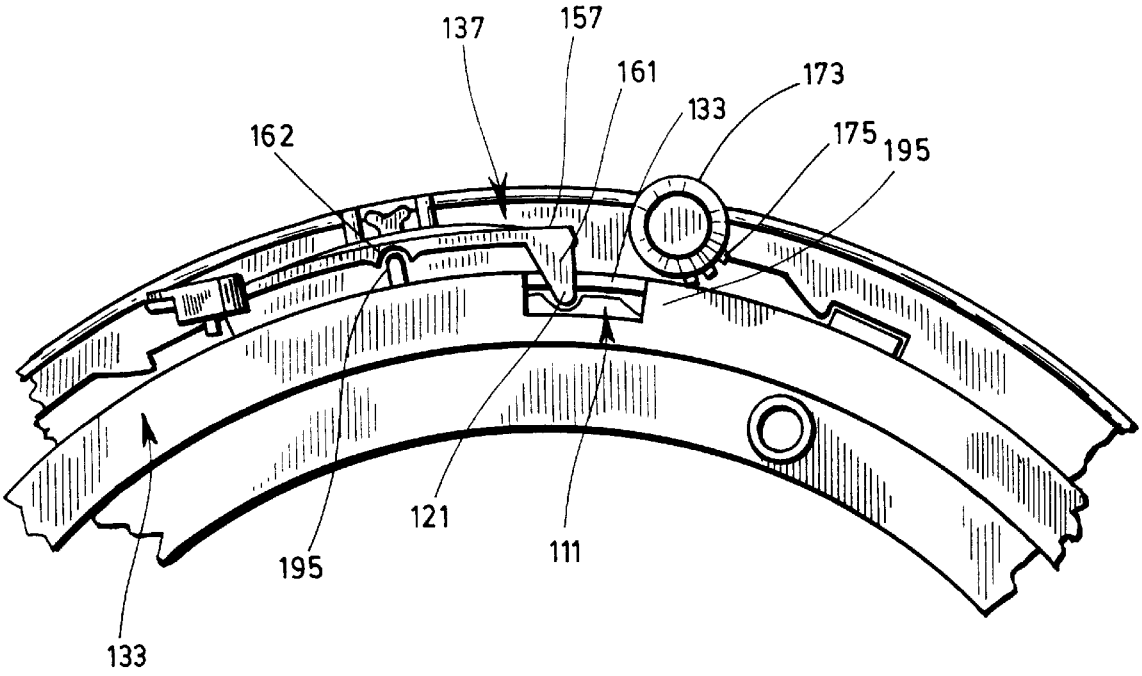
FIG. 13 is a side elevational, partially cut-away view of the portion of the spool-receiving element where the tooth of the brake engages the teeth of the spool.

As is shown in FIGS. 11A to C, the spool-receiving element 133 can be connected to the cover 183 by inserting its hooks 147 into the first portion 189 of a set of corresponding slots 187 (FIG. 11B). Then, the cover 183 can be rotated so as to move the hooks 147 from the first portions of the slots to the second portions 191 of the same slots though the channels 193. In these second portions, the hooks 147 are "snapped" and are held in place by means of the notches 195 (FIG. 11C).

Of course, an outlet 163 is provided in the surrounding wall 143 of the spool-receiving element 133 to allow the pintle 103 wound on the spool 111 to be pulled out. As is shown in FIG. 9, the outlet 163 is elongated and rectangular and extends centrally on the surrounding wall 143. Preferably, the end 164 of the outlet 163 where the pintle 103 exits, is inwardly tapered.

The spool assembly 101 according to the second preferred embodiment of the invention, also comprise a brake 137 connected to the spool-receiving member 131. Brake-holding means are provided for holding the brake 137 in operative position relative to the spool 111 held in the spool-receiving member 131. These brake-holding means comprise a bead 195 that is part of and projects from the surrounding wall 143 of the spool-receiving element 133. As better shown in FIGS. 9 and 12A and B, the bead 195 is perpendicular to the outlet 163 and extends at a short distance from the same. The brake-holding means also comprises a V-shaped claw 197 projecting from the peripheral portion 185 of the cover 183 so as to extend just above the bead 195 when the spool-receiving element 133 is "properly" connected to the cover 183. The bead 195 and claw 197 act together as a pivot for the brake 137 which comprises a tiltable arm 157 which extends substantially tangentially close to the spool 111 once it is slid and "snapped" between the bead 195 and claw 197. The arm 157 has, in its middle portion, an integral upwardly projecting boss 158 supporting a set of retaining tabs 160 whose purpose is to ensure that the arm 157 remains centrally positioned for pivotal motion between the bead 195 and the claw 197. The arm also comprises a notch 162 in its bottom surface below the boss 158, for pivotal engagement onto the bead 195.

The brake 137 comprises a tooth 161 that projects downwardly from one end of the arm 157 so as to contact and engage the teeth 121 of the spool 111. To allow such a contact, an opening 199 is provided in the walls 145 and 157 of the spool-receiving element 133 close to the end 164 of the outlet 163.

Once the brake 137 is installed, its tooth 161 engages the teeth 121 of the side wall 119 of the spool 111 and thus prevents unwanted backward rotation of the spool 111 in the direction "A". Release of the spool 111 to rewind the pintle may only be achieved by tilting up the arm 157, which is otherwise held "down" with its tooth in locking position by means of a rubber sleeve 201 sized and shaped to be slid onto the end of the arm 157 that is opposite to the one where is located the tooth 161. The sleeve 201 has an upper surface defining an element on which the user may press with his/her thumb (see FIG. 15), and a lower surface from which projects a resilient finger 203 which is pressed down and squeezed between the arm 157 and the surrounding wall 143 when a pressure is exerted onto the sleeve 201. This finger 203 acts as a "return spring" and tilts the arm 157 back to its original position where the tooth 161 engages the teeth 121 of the spool and prevents it from rotating in the direction "A".

Figure 14:
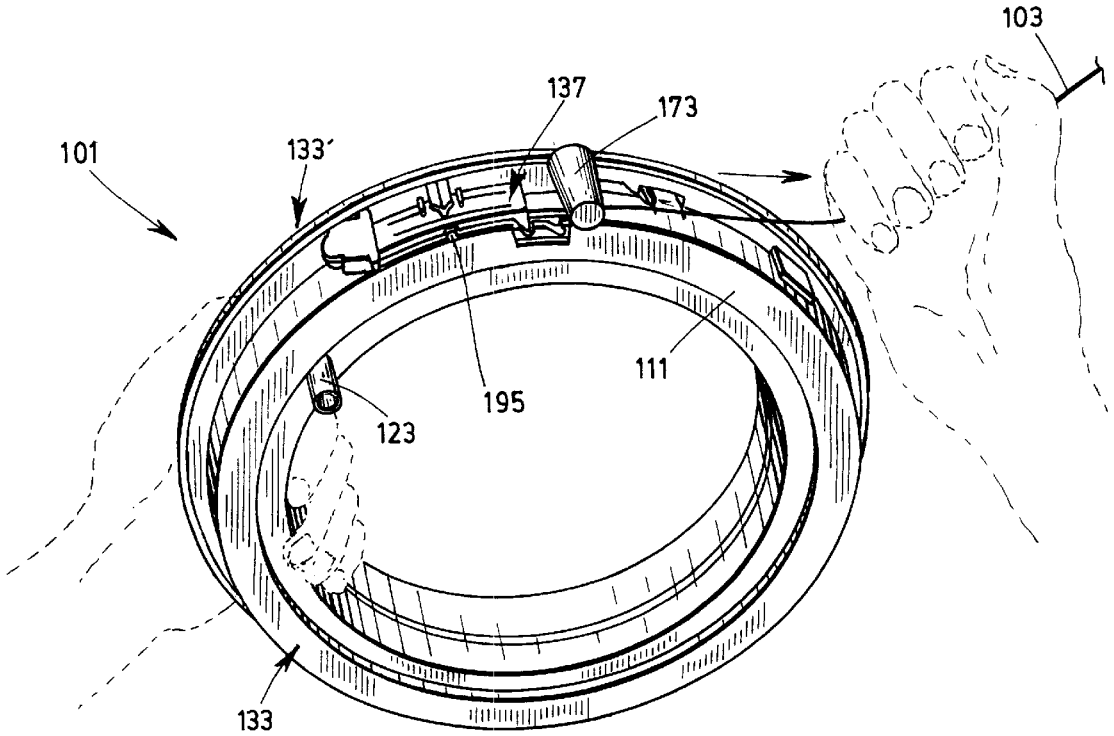
FIGS. 14 and 15 are front perspective views of the spool assembly according to the second preferred embodiment of the invention, shown assembled with two spool-receiving elements and two spools, said views illustrating the assembly when used to unbound the pintle (FIG. 14) and to rewind the same (FIG. 15).
Figure 15:
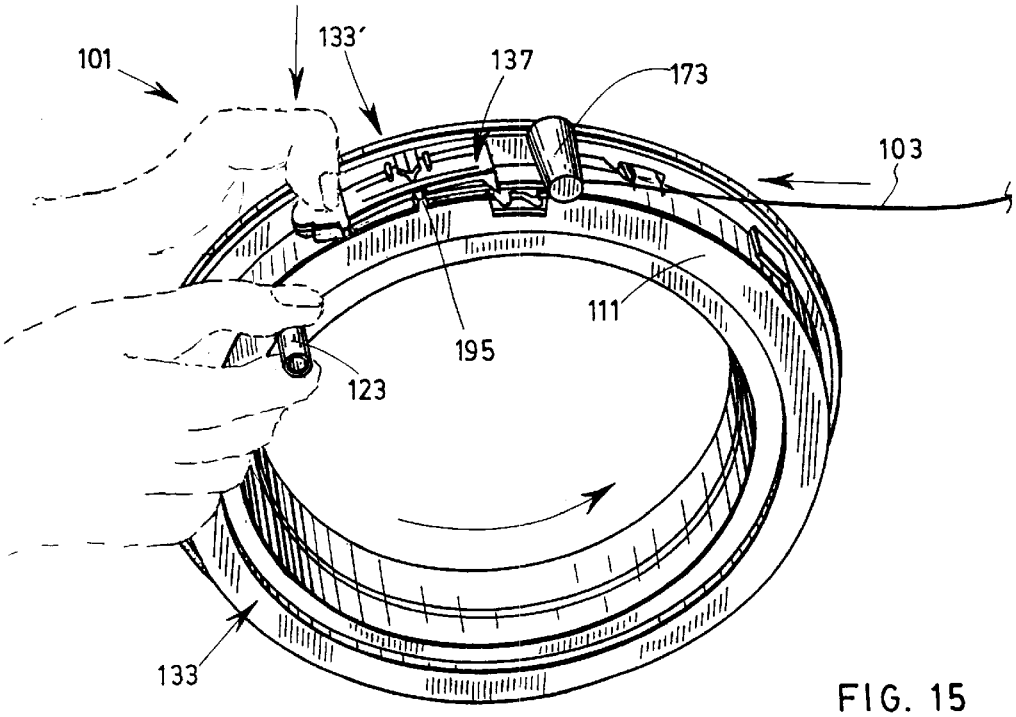

FIGS. 14 and 15 illustrate the operation of the spool assembly 101. As can be seen, the user holds firmly and with one hand only the spool assembly 101. By properly positioning his/her hand relative to the brake 137, the user may also press with his/her thumb on the sleeve 201 of the brake 137 to lift the tooth 161 whenever such is desired. When the brake is not tilted up, the user may still pull the pintle 103 out of the spool assembly 1 because the tooth 66 "slips" over those of the spool 101. When the brake is tilted up, the spool 11 may be rotated counter-clockwise with the help of the stem 123 to rewind the portion of the pintle 103 that protrudes from the assembly 101.

Like the spool assembly 1, the spool assembly 101, preferably comprises also a stopper. This stopper comprises a rod 171 integrally projecting perpendicularly from the peripheral portion 185 of the cover 183 so as to extend close to the surrounding wall 143 of the spool-receiving element 133 at a short distance away from the outlet 163 when the spool-receiving member 131 is assembled. The stopper also comprises a rubber cap 173 having radially projecting flanges 175 on part of it. The cap 173 is fitted onto the rod 141 and sized so that, when it is rotated, its flanges 175 may come into contact with the surrounding wall 143 and pinch the pintle 103 extending on it, thereby locking this pintle whenever desired (see FIGS. 14 and 15).

In the above description of the spool assembly 101, reference has been made to one single spool 111 held in a spool-receiving element 133 hooked to the cover 183. In accordance with a variant of this second preferred embodiment of the invention, the spool assembly 101 may comprise two separate spools 111 held in parallel relationship in two spool receiving elements 133, 133' (see FIGS. 9, 14 and 15) hooked on both sides of the same cover 183. For this purpose, the cover 183 has another "opposite" set of hook receiving slots 187 sized and positioned to receive the hooks 147' of the second spool receiving element 133'. The cover 41 also has a second claw, similar to the first claw 197 but extending in the opposite direction, for holding another brake provided on the second spool receiving element 133'. This second claw is preferably spaced-apart from the first claw at a distance that substantially corresponds to the size of a hand. This, makes it possible for the user to hold, store and supply two distinct pintles whenever required.

As stated hereinabove, the spool assembly 1 and 101 according to the invention are preferably made of plastic material. More preferably to obtain a up-market, transparent and shock resistant product, the spool receiving element 33, 133 and the cover 183 in the case of the second embodiment, can be made of polycarbonate whereas the spool 11, 111 is made of polystyrene. Polystyrene is cheaper than polycarbonate and it offers better sliding of the spool 11, 111 within the spool assembly 1, 101. The spool 11, 111 may also be coloured to increase the aesthetic appearance of the whole assembly.

In a cheaper and more shock sensitive commodity version of the assembly, the spool receiving element 33, 133 and the cover 183 can be opaque. In this version, the spool receiving element 33, 133 and the spool 11, 111 may be made of polypropylene whereas the cover 183 can be made of polystyrene. This choice of plastic material permits to obtain a very good sliding of the spool 11 within the assembly. The product obtained therefore is clearly cheaper than the existing up-market similar products.

Although two preferred embodiments of the invention have been described in detail herein also and illustrated in the accompanying drawings, it should be understood that the invention is not limited to these embodiments and that various changes and modifications could be made therein without departing from the scope or spirit of the invention. By way of example, accordingly to the type and the size of the pintle 3, 103 that is used, it could be advantageous to adjust the respective positions of the outlet, brake and stopper(s).

What is claimed is:

1. A spool assembly (1; 101) for storing and handling a wire (3; 103), comprising:

a spool (11; 111) of given outer diameter and thickness on which the wire to be stored can be wound, said spool being annular in shape and devised to define a radially outwardly opened rim (13; 113) of U-shaped cross-section in which the wire can be wound, said rim having a bottom wall in the form of an annular ring and two side walls (17, 19; 117; 119) in the form of flat rings that project radially outwardly from both sides of the annular ring, at least one (19; 119) of said side walls having an outer edge with teeth formed in it, said teeth (21; 121) being equally spaced-apart, identical in size and all oriented in a same direction (A); and a spool-receiving member (31; 131) comprising:

a spool-receiving element (33; 133) comprising a surrounding wall (43; 143) having an inner diameter and a width selected to match with the outer diameter and thickness of the spool (11; 111), and a ring-shaped wall (45; 145) that projects radially inwardly from one side of the surrounding wall to provide a lateral support on one side of the spool;

means (47, 47'; 147) connected to the spool-receiving member (31; 131) for catching the spool (11, 111) and freely retaining said spool (11; 111) within the spool-receiving element (33; 133);

an outlet (63; 163) provided in the surrounding wall (43; 143) of the spool-receiving element (33; 133) to allow the wire wound on the spool (11; 111) to exit from the spool-receiving member (31; 131); and a brake (37; 137) connected to the spool-receiving member (31; 131) said brake comprising a tiltable arm (57; 157) extending substantially tangentially close to the spool (11; 111) and at least one tooth (61; 161) projecting from said tiltable arm (57; 157) so as to contact said spool, said at least one tooth (61; 161) being shaped, sized and oriented in a direction opposite to the said direction (A) so as to engage the teeth of the one side wall of the spool and thus to prevent said spool from being rotated in the said direction "A" unless the arm (57, 157) tilted is up.

2. A spool assembly as claimed in claim 1, wherein said assembly further comprises at least one stopper fixed to the spool-receiving member (31; 131), said at least one stopper comprising a rod (41; 141) extending transversely close to the surrounding wall (43; 143) of the spool-receiving member (31; 131) at a short distance away from the outlet (63; 163) and a rubber cap (73; 173) having radially projecting flanges (75; 175) on part of it, said cap being fitted onto the rod and sized so that, when it is rotated, its flanges may come into contact with the surrounding wall (43; 143) and pinch the wire extending on it, thereby locking said wire.

3. A spool assembly as claimed in claim 2, wherein the spool (11; 111) comprises a stem (23; 123) projecting externally from one (19; 119) of the side walls of said spool, said stem allowing one to impart manual rotation to the spool whenever required.

4. A spool assembly as claimed in claim 3, wherein said spool (11; 111) and spool-receiving member (31; 131) are made of plastic material.

5. A spool assembly as claimed in claim 4, wherein:

said means for catching the spool (11) consists of a set of circumferentially spaced-apart hooks (47, 47') projecting from the ring-shaped wall (45), said hooks being sized, positioned and oriented to catch the spool and freely retain it within the spool-receiving element (33);

said spool-receiving element (33) comprises an handle (35) integral thereto and projecting externally therefrom;

the tiltable arm (57) of the brake (37) consists of a flexible partially cut-out portion of the surrounding wall (43) of the spool-receiving element (33), said cut-out portion extending below the handle (45); and the brake (37) also comprises a ring (59) integral to the flexible portion of the surrounding wall (43) said ring (59) being sized, shaped and oriented in such a manner as to be engageable by one finger of a user holding the spool assembly by the handle (35) so as to disengage the at least one tooth (61) from the teeth (21) of the spool (11).

6. A spool assembly as claimed in claim 5, wherein:

the spool-receiving member (31) comprises a substantially flat supporting surface (65) external to the spool-receiving element (33) just behind the outlet (63) provided in the surrounding wall (43) said supporting surface (67) being part of the surrounding wall (43) and being used to support and guide the wire (31) exiting from the outlet (63);

the spool-receiving member (31) also comprises a supporting wall (67) extending in a radial plane parallel to the side walls (17, 19) of the spool (11) and to the ring-shaped wall (45) of the spool-receiving element (33); and the rod (41) of said at least one stopper is integral to and projects perpendicularly from the supporting wall (67) at a short distance from the supporting surface (67).

7. A spool assembly as claimed in claim 6, wherein said assembly comprises two of said at least one stopper, the other one of said stoppers comprising a slotted rod (39) integral to and projecting perpendicularly from the supporting wall (67) at a short distance away from the supporting surface (47) and a rubber peg (69) sized to be inserted into said slotted rod, said peg (69) having a radially projecting tongue (71) that comes into contact with and bears against the supporting surface (47) and the wire (3) extending on it.

8. A spool assembly as claimed claim 4, wherein:

said means for catching the spool (111) comprises a set of a circumferentially spaced-apart hooks (147) projecting from the surrounding wall (143), said hooks (147) being sized, positioned and oriented to engage a corresponding set of hook-receiving slots (187) provided in a cover (183) in the form of a flat ring extending in a plane perpendicular to the central axis of the spool-receiving element (133) when hooked thereto, said cover (183) having an external diameter long enough to make the slots (187) engageable by the hooks (147) and being held tight by these hooks (147) against the spool-receiving element (133) to form therewith casing in which the spool (111) is freely mounted; and the tiltable arm (157) of the brake (137) is held onto the spool-receiving member between a bead (195) projecting from the surrounding wall (143) and a claw (197) projecting from the cover (183) so as to extend just above the bead (195) when the spool-receiving element (133) is properly connected to the cover (183), the bead (195) and claw (197) acting together as a pivot for the tiltable arm (157) when the same is slid and snapped therebetween.

9. A spool assembly as claimed in claim 8, wherein the tiltable arm (157) has:

a middle portion with an integral upwardly projecting boss (158) supporting a set of retaining tabs (160) extending on both sides of the claw (197);

a bottom surface with a notch extending below the boss (158) for pivotal engagement onto the bead (195);

a first end where is located the at least one tooth (161); and an opposite end covered by a rubber sleeve (201) having a lower surface from which projects a resilient finger (203) which when unpressed by a finger, acts as a return spring and tilts the arm (157) in a position where the at least one tooth (161) engages the teeth (121) of the spool (111).

10. A spool assembly as claimed in claim 9, wherein the brake (137) extends over the outlet (163) and has one single tooth (161) that passes through an opening 199 provided in the walls (145, 157) of the spool-receiving element (133).

11. A spool assembly as claimed in claim 9, wherein the rod (141) of the at least one stopper is integral to and projects perpendicularly from the cover (183) so as to extend close to the surrounding wall (143) at a short distance away from the outlet (163).

12. A spool assembly as claimed in claim 9, comprising two of said spools (111) held in parallel relationship in two spool-receiving elements (133, 133') hooked on both sides of the cover (183), each of said spools and spool-receiving elements having a corresponding set of brake and stopper.

13. A spool assembly as claimed in claim 2, wherein:

said means for catching the spool (11) consists of a set of circumferentially spaced-apart hooks (47, 47') projecting from the ring-shaped wall (45), said hooks being sized, positioned and oriented to catch the spool and freely retain it within the spool-receiving element (33);

said spool-receiving element (33) comprises an handle (35) integral thereto and projecting externally therefrom;

the tiltable arm (57) of the brake (37) consists of a flexible partially cut-out portion of the surrounding wall (43) of the spool-receiving element (33), said cut-out portion extending below the handle (45); and the brake (37) also comprises a ring (59) integral to the flexible portion of the surrounding wall (43) said ring (59) being sized, shaped and oriented in such a manner as to be engageable by one finger of a user holding the spool assembly by the handle (35) so as to disengage the at least one tooth (61) from the teeth (21) of the spool (11).

14. A spool assembly as claimed in claim 13, wherein:

the spool-receiving member (31) comprises a substantially flat supporting surface (65) external to the spool-receiving element (33) just behind the outlet (63) provided in the surrounding wall (43) said supporting surface (67) being part of the surrounding wall (43) and being used to support and guide the wire (31) exiting from the outlet (63);

the spool-receiving member (31) also comprises a supporting wall (67) extending in a radial plane parallel to the side walls (17, 19) of the spool (11) and to the ring-shaped wall (45) of the spool-receiving element (33); and the rod (41) of said at least one stopper is integral to and projects perpendicularly from the supporting wall (67) at a short distance from the supporting surface (67).

15. A spool assembly as claimed in claim 14, wherein said assembly comprises two of said at least one stopper, the other one of said stoppers comprising a slotted rod (39) integral to and projecting perpendicularly from the supporting wall (67) at a short distance away from the supporting surface (47) and a rubber peg (69) sized to be inserted into said slotted rod, said peg (69) having a radially projecting tongue (71) that comes into contact with and bears against the supporting surface (47) and the wire (3) extending on it.

16. A spool assembly as claimed in claim 2, wherein:

said means for catching the spool (111) comprises a set of a circumferentially spaced-apart hooks (147) projecting from the surrounding wall (143), said hooks (147) being sized, positioned and oriented to engage a corresponding set of hook-receiving slots (187) provided in a cover (183) in the form of a flat ring extending in a plane perpendicular to the central axis of the spool-receiving element (133) when hooked thereto, said cover (183) having an external diameter long enough to make the slots (187) engageable by the hooks (147) and being held tight by these hooks (147) against the spool-receiving element (133) to form therewith casing in which the spool (111) is freely mounted; and the tiltable arm (157) of the brake (137) is held onto the spool-receiving member between a bead (195) projecting from the surrounding wall (143) and a claw (197) projecting from the cover (183) so as to extend just above the bead (195) when the spool-receiving element (133) is properly connected to the cover (183), the bead (195) and claw (197) acting together as a pivot for the tiltable arm (157) when the same is slid and snapped therebetween.

17. A spool assembly as claimed in claim 16, wherein the tiltable arm (157) has:

a middle portion with an integral upwardly projecting boss (158) supporting a set of retaining tabs (160) extending on both sides of the claw (197);

a bottom surface with a notch extending below the boss (158) for pivotal engagement onto the bead (195);

a first end where is located the at least one tooth (161); and an opposite end covered by a rubber sleeve (201) having a lower surface from which projects a resilient finger (203) which when unpressed by a finger, acts as a return spring and tilts the arm (157) in a position where the at least one tooth (161) engages the teeth (121) of the spool (111).

* * * * *